US011000136B2

(12) United States Patent
Katz et al.

(10) Patent No.: US 11,000,136 B2
(45) Date of Patent: May 11, 2021

(54) DISPLAY SYSTEM FOR DECORATIVE MATERIAL AND ARTWORK

(71) Applicants: Louise J. Katz, Mountain View, CA (US); Joanne M. Glass, Northbrook, IL (US)

(72) Inventors: Louise J. Katz, Mountain View, CA (US); Joanne M. Glass, Northbrook, IL (US)

(73) Assignee: Louise J. Katz, Mountain View, CA (US)

( * ) Notice: Subject to any disclaimer, the term of this patent is extended or adjusted under 35 U.S.C. 154(b) by 3 days.

(21) Appl. No.: 16/110,829

(22) Filed: Aug. 23, 2018

(65) Prior Publication Data

US 2020/0060444 A1 Feb. 27, 2020

(51) Int. Cl.
*A47G 1/06* (2006.01)

(52) U.S. Cl.
CPC ..... *A47G 1/0616* (2013.01); *A47G 1/065* (2013.01); *A47G 1/0633* (2013.01)

(58) Field of Classification Search
CPC .... A47G 1/0616; A47G 1/0633; A47G 1/065; A47G 1/06; A47G 1/0627; G09F 1/12
USPC ..... 40/603, 732, 781, 798, 799, 768, 730; 38/102.2
See application file for complete search history.

(56) References Cited

U.S. PATENT DOCUMENTS 480,953 A 8/1892 Mauerhofer
1,463,150 A * 7/1923 Carisen ..... A47G 1/143 40/781
1,807,288 A 6/1929 Herbert
2,223,674 A * 12/1940 Cohen ..... A47G 1/0627 40/799
2,697,889 A 4/1954 Heim
3,956,838 A 5/1976 Gerrish
4,286,400 A 9/1981 MacPherson et al.
4,939,858 A 7/1990 Dailey
4,967,499 A 11/1990 Rosenberg
5,230,172 A * 7/1993 Hsu ..... A47G 1/06 248/497
5,286,558 A 2/1994 Seo et al.
5,581,925 A 12/1996 Snoke et al.
6,209,248 B1 4/2001 Reinhard
6,820,360 B2 11/2004 Glazer
7,587,847 B2 9/2009 Lasher
7,918,063 B2 * 4/2011 Etemadi ..... E06B 3/549 52/455
9,888,791 B2 2/2018 Guitton
2002/0108285 A1 * 8/2002 Wohlleb ..... A47G 1/06 40/732
2005/0016045 A1 * 1/2005 Lasher ..... A47G 1/06 40/759

(Continued)

*Primary Examiner* — Cassandra Davis

(74) *Attorney, Agent, or Firm* — Aurora Consulting LLC; Lynn M. Thompson; Ashley Sloat

(57) ABSTRACT

Display systems and methods are provided to utilize material, particularly needlework material such as canvas work or surface embroidered material, to mat or decoratively surround a piece of artwork for display. Such material is stretched and held in place by the display system so as to provide a desirable aesthetic result. The display systems are easily removable or changeable, allowing customization. Likewise, such display systems may be used with conventional frames.

31 Claims, 10 Drawing Sheets

(56) References Cited

U.S. PATENT DOCUMENTS

| | | | |
|---|---|---|---|
| 2015/0082677 | A1 | 3/2015 | Crump et al. |
| 2016/0073796 | A1 | 3/2016 | Nesbitt |

* cited by examiner

DETAIL D

DETAIL K

DISPLAY SYSTEM FOR DECORATIVE MATERIAL AND ARTWORK

BACKGROUND OF THE INVENTION

Family photos, scenic images, children's artwork, local masterpieces, these are the items typically chosen to be hung on the walls of rooms to make a space feel personal. Each decoration tells a story—a family vacation, a wedding day, a first day of school, an award, a favorite saying. Wall hangings display what is important or valued by the host. Some involve hours and hours of meticulous artistic work. Some are handed down from generation to generation.

In order to preserve these mementos and create a finished look for hanging, such artwork is often framed. Frames are typically composed of wood which has been joined together using a variety of techniques such as mitering or lap joining. The frame surrounds the artwork, providing support and protection. The frame is also stylistically appropriate for the work of art it surrounds. Therefore, frames enhance the artwork, sometimes becoming part of the artwork itself.

In addition, many styles of artwork are also matted. Traditionally, a mat or mount is a thin, flat piece of paper-based material included within a picture frame, which serves as additional decoration and can perform a variety of other more practical functions. Such mats surround or border the artwork and reside between the artwork and the edges of the frame. Typically, the mat serves to help draw the eye in towards the framed piece, or towards a particular key element of the piece. However, while the mat is usually regarded as something to complement or set off the artwork to best effect, or not to interfere or compete with it, there are some examples of the mat being regarded by the artist as a part of the artwork. Mats can be decorated, used as a surface for the continuation of the artwork within, or can incorporate three-dimensional aspects.

In some instances, mats are covered with fabric or decorative material. Such fabric is often a thin sheet that is plain in color or printed with a design. However, at times the fabric is enhanced with embroidery or other detailed needlework. The fabrics and yarns used in traditional embroidery vary from place to place. Wool, linen, and silk have been in use for thousands of years for both fabric and yarn. Today, embroidery thread is manufactured in cotton, rayon, and novelty yarns as well as in traditional wool, linen, and silk. Ribbon embroidery uses narrow ribbon in silk or silk/organza blend ribbon, most commonly to create floral motifs. At times, embroidery may also incorporate other materials such as pearls, beads, quills, and sequins.

Canvas work is another type of embroidery in which yarn is stitched through a canvas or other foundation fabric. Canvas work is a form of counted-thread embroidery. Common types of canvas work include needlepoint, petit point, and bargello.

In both canvas work and surface embroidery, an embroidery hoop or frame is used to stretch the material and ensure even stitching tension that prevents pattern distortion. Modern canvas work tends to follow symmetrical counted stitching patterns with designs emerging from the repetition of one or just a few similar stitches in a variety of hues. In contrast, many forms of surface embroidery make use of a wide range of stitching patterns in a single piece of work. In both instances, the work is released from the hoop or frame when finished and the material recoils into an irregular form due to the stress of the stitchery. To properly view the work, the material needs to be evenly stretched and held in place so that the pattern resumes its original configuration. This typically involves professional stretching and mounting to create a uniform, desirable result. Once accomplished, the work is rarely released so as to avoid the expense of repeating the process.

Due to these challenges in preparing canvas work and embroidered fabric for display, such materials are rarely utilized to embellish or accentuate matting in frames. By design, mats have an opening in the center to allow viewing of the photo or artwork. Such an opening breaks any continuity of the material across the piece. Thus, the material cannot be stretched from its outside edges due to free edges existing around the center opening. Likewise, such free edges are subject to fraying, bunching and unsightly gapping as the material is attempted to be pulled into the opening and fixed in place. Even if a desired result is accomplished, the mating material is typically glued or adhered in place so as to permanently capture its position and maintain it over time.

Thus, devices, systems and methods are desired to allow material, particularly needlework material such as canvas work or surface embroidered material, to be utilized to mat or decoratively surround a piece of artwork for display. Such devices, systems and methods should provide a desirable aesthetic result, be easily removable or changeable, allow customization and preserve both the material and the artwork for future use. In addition, such devices and systems should be easy to use and cost effective. At least some of these objectives are met by the present invention.

SUMMARY OF THE INVENTION

The present invention generally relates to systems, devices and methods of displaying artwork and the like, and more particularly relates to effectively utilizing material visually benefiting from stretching to mat or decoratively surround a piece of artwork for display.

In a first aspect of the present invention, a display system is provided for displaying a decorative panel and artwork, wherein the display system comprises a) a support backing configured to receive the decorative panel and the artwork in an arrangement so that the artwork is viewable through an opening in the decorative panel, wherein the decorative panel comprises a board structure having a surface coverable with a decorative material so that a portion of the decorative material extends through the opening, and b) an insert having a front side and a back side which is removably attachable to the support backing, wherein at least one wall extends from the back side of the insert which pulls at least some of the material extending through the opening in tension while the front side frames the opening of the decorative panel.

In some embodiments, the support backing has a platform configured to receive the artwork upon its top surface, wherein the platform has a side wall at least partially around its perimeter and wherein the top surface is raised above the support backing so that the platform fits within the opening of the decorative panel. It may be appreciated that in some embodiments, the top surface is raised above the support backing in a range of 0.062 to 0.875 inches. Likewise, in some embodiments the at least one wall extends between the side wall of the platform and an edge of the opening of the decorative panel during attachment.

In some embodiments, the support backing includes at least one base attachment feature along the perimeter of the platform and the insert includes at least one insert attachment feature along the at least one wall, wherein the at least one base attachment feature and the at least one insert attachment feature are releasably joinable to cause the insert to be removably attachable to the support backing. In some embodiments, at least one of the at least one base attachment features comprises a clip having a protrusion and at least one of the at least one insert attachment features comprises a window for receiving the protrusion. In some embodiments, insertion of the at least one wall through the opening of the decorative panel aligns the protrusion with the window so that the protrusion extends therethrough resisting release of the insert from the backing panel. It may be appreciated that in some instances the protrusion is shaped to allow withdrawal of the protrusion from the window upon pulling the insert away from the support backing.

In some embodiments, the insert comprises border segments surrounding an insert opening and wherein each of the at least one walls extends from the backside of the insert so that there is a first area between the wall and the insert opening and a second area between the wall and an outer edge of the insert, wherein the first area is configured to extend over a portion of the opening of the decorative panel and the second area is configured to extend over a portion of the decorative panel when the insert is removably attached to the support backing.

It may be appreciated that in some embodiments the support backing is configured to be inserted into a picture frame.

In some embodiments, the display system further comprises the board structure having the surface coverable with the decorative material so that a portion of the decorative material extends through the opening. Optionally, the display system further comprises fixation devices for removably fixing the decorative material to the board structure. Likewise, the display system optionally further comprises a cutting guide configured to establish a shape for the decorative material for covering the surface of the board structure. It may be appreciated that in some embodiments the shape established by the cutting guide creates flaps for the portion of the decorative material extending through the opening.

In some embodiments, the decorative material comprises a canvas or fabric having needlework thereon.

In a second aspect of the present invention, a display system is provided for displaying a decorative panel and artwork, wherein the display system comprises a support backing comprising a) a receiving area configured to receive the decorative panel, wherein the decorative panel has a panel opening surrounded by borders, b) a platform disposed along the support backing configured to receive the artwork, wherein the platform has side walls at least partially around its perimeter and has a top surface raised above the support backing so that the platform fits within the panel opening when the decorative panel is positioned on the receiving area, and c) at least one base attachment feature. The display system also includes an insert comprising border segments surrounding an insert opening, wherein the insert includes at least one wall protruding from a back side of the insert and at least one insert attachment feature, wherein a surface of the at least one wall extends along at least one side wall of the platform and the at least one insert attachment feature joins with the at least one base attachment feature so as to removably hold the insert and decorative panel in relation to the support backing so that the artwork is viewable through the panel opening and the insert opening.

In a third aspect of the present invention, a method of displaying a decorative panel and artwork are provided comprising a) positioning the artwork on a platform of a support backing, b) positioning the decorative panel on a receiving area surrounding the platform so that the artwork is visible through an opening in the decorative panel, wherein the decorative panel comprises a board structure at least partially covered by a decorative material, c) aligning an insert so that its opening is concentric with the opening of the decorative panel, wherein the insert includes at least one wall protruding from a back side of the insert and at least one insert attachment feature, and d) advancing the at least one wall between the platform and the decorative panel so that at least a portion of the decorative material is drawn toward the opening of the decorative panel in tension.

In some embodiments, the insert includes at least one insert attachment feature and the support backing includes at least one base attachment feature, wherein the method further comprises joining the at least one insert attachment feature with the at least one base attachment feature to attach the insert to the support backing.

In some embodiments, the method further comprises unjoining the at least one insert attachment feature from the at least one base attachment feature to detach the insert from the support backing.

In some embodiments, the method further comprises removing the decorative panel from the receiving area, replacing the decorative material with another decorative material and repositioning the decorative panel having the another decorative material on the receiving area.

Likewise, in some embodiments, the method further comprises inserting the support backing into a picture frame. These and other embodiments are described in further detail in the following description related to the appended drawing figures.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Specific embodiments of the disclosed devices, systems, and methods will now be described with reference to the drawings. Nothing in this detailed description is intended to imply that any particular component, feature, or step is essential to the invention.

Overview

Figure 1:
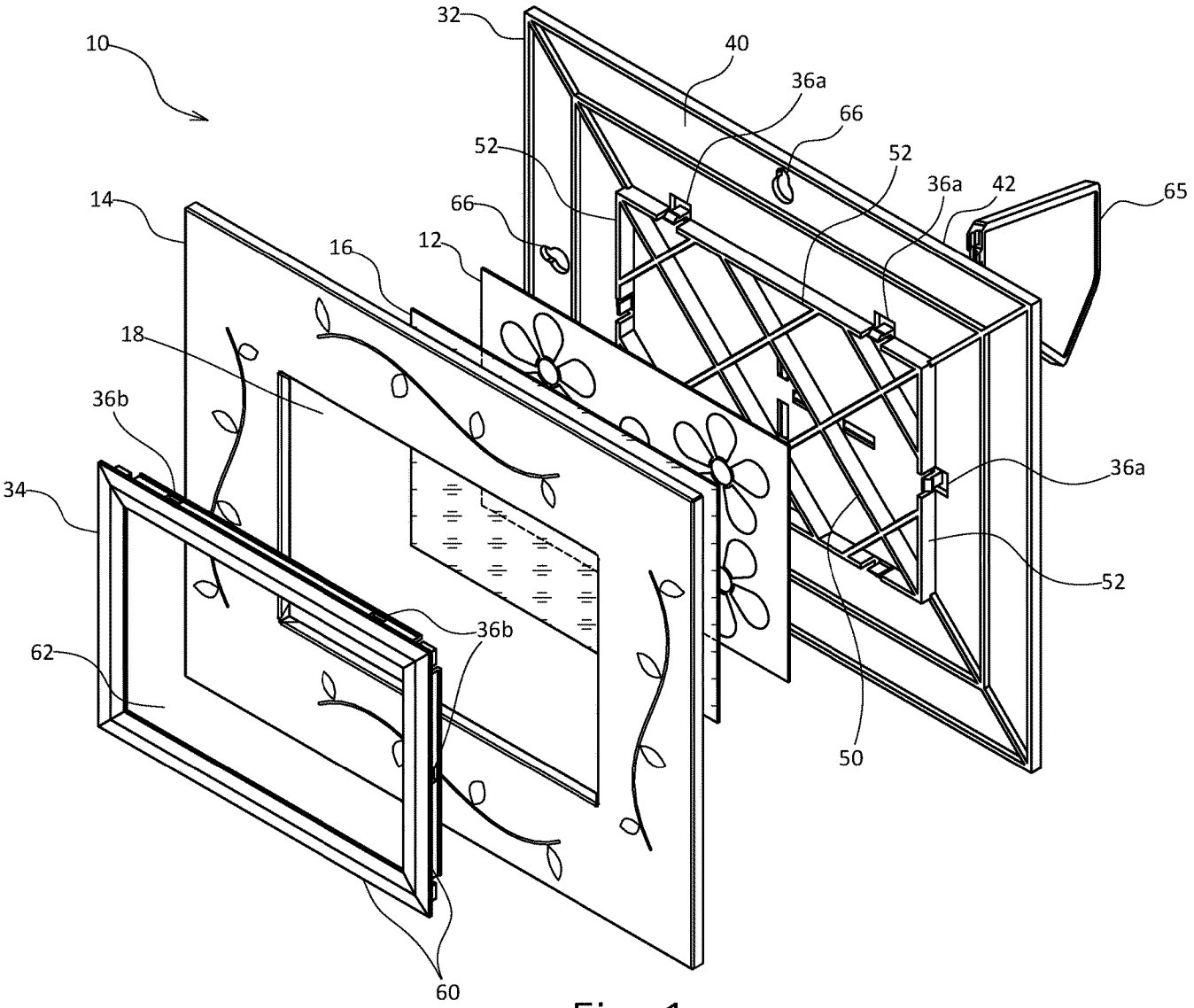
FIG. 1 illustrates an embodiment of a display system for displaying both a piece of artwork and a decorative panel configured to surround and enhance the artwork.

FIG. 1 illustrates a display system 10 for displaying both a piece of artwork 12 and a decorative panel 14 configured to surround and enhance the artwork 12. It may be appreciated that the artwork 12 may have any suitable form, including a photograph, drawing, painting, writing, etching, carving, or three-dimensional structure (such as a ticket stub, trinket, or pressed flower), to name a few. Three-dimensional structures are typically mounted on or positioned in front of a backdrop so as to provide a background for the three-dimensional structure. The artwork may have any suitable shape, including rectangular, square, circular, or oval, to name a few. In some embodiments, the artwork 12 is covered by a clear sheet 16, such as a panel of glass or plastic. The clear sheet 16 protects the artwork 12 from the environment. In such embodiments, the artwork 12 typically has an overall planar shape so as to be easily covered by the clear sheet 16. However, it may be appreciated that in some embodiments the clear sheet 16 is not used so as to expose the artwork and allow space for any protrusions therefrom, such as from a three-dimensional structure.

The decorative panel 14 functions as a type of framing mat for the artwork 12. Thus, the decorative panel 14 has an opening 18 (through which the artwork 12 is viewable) and borders 20 that surround the opening 18. The opening 18 may be centered within the panel 14 or offset. The opening 18 may have any suitable shape, including rectangular, square, circular, or oval, to name a few. The shape of the opening 18 typically matches the outer shape of the artwork 12. In some embodiments, the decorative panel 14 is comprised of a board structure upon which decorative material is mounted (as will be described and illustrated in later sections). In some embodiments, the decorative material comprises a canvas, fabric or similar material which includes needlework such as embroidery, needlepoint, cross-stitch, petit point, and bargello, to name a few. Thus, the decorative panel 14 displays both the decorative material and the artwork 12, when aligned in relation to each other.

The decorative panel 14, artwork 12 and optional clear sheet 16, are held together in such alignment by an interlocking mounting structure 30. The structure 30 is comprised of a support backing 32 and an insert 34, wherein the support backing 32 and insert 34 are removably interlockable by the joining of attachment features 36*a*, 36*b*. The support backing 32 is typically comprised of a rigid material which supports at least the artwork 12, the decorative panel 14 and the insert 34. In this embodiment, the support backing 32 is broad and planar, having a front side 40 and a back side 42. The front side 40 of the support backing 32 includes a platform 50 upon which the artwork 12 is mounted. The platform 50 is raised above the remainder of the support backing 32 so as to elevate the artwork 12 and allow positioning through the opening 18 of the decorative panel 14. Thus, the remainder of the support backing 32 includes a receiving area for the decorative panel 14 so that the decorative panel 14 surrounds the artwork 12 like a framing mat.

In some embodiments, the platform 50 is solid, however as illustrated in the embodiment of FIG. 1, portions of the platform 50 may be removed leaving a series of cross-bars or support beams configured to form the platform 50 so as to conserve material and reduce weight. It may be appreciated that the platform 50 may alternatively be constructed in this manner (such as by molding) without removing material. Since the platform 50 is raised, the platform 50 includes at least one side-wall 52 that defines a perimeter of the platform 50. In some embodiments, base attachment features 36*a* are disposed along the at least one side-wall 52, as shown.

The insert 34 is comprised of one or more border segments 60 that surround an opening 62. The one or more border segments 60 are relatively narrow so as to "frame" the opening 62 and therefore artwork 12 without obscuring the decorative panel 14. The opening 62 of the insert may have a variety of shapes, including rectangular, square, circular or oval to name a few. In this embodiment, the opening 62 has a rectangular shape and therefore the one or more border segments 60 form a rectangle. It may be appreciated that in any given embodiment, the opening 62 of the insert 34 and the opening 18 of the decorative panel 14 are consistent so as to allow alignment. Likewise, the openings 18, 62 are consistent with the size and shape of the platform 50 of the support backing 32 so as to also allow alignment. The insert 34 includes a plurality of insert attachment features 36*b* which mate with base attachment features 36*a*, such as along the platform 50 of the support backing 32.

As shown in FIG. 1, assembly of this embodiment includes positioning the artwork 12 and clear sheet 16 upon the platform 50 of the support backing 32. The decorative panel 14 is then positioned upon the receiving area of the support backing 32 so that its opening 18 aligns with the platform 50, revealing the artwork 12 (covered by clear sheet 16) therethrough. The insert 34 is then positioned so that its opening 62 is aligned with the opening 18 of the decorative panel 14. The insert 34 is then pressed downward onto the support backing 32 so that the attachment features 36*a*, 36*b* join. Thus, in this embodiment, at least the insert attachment features 36*b* extend through the opening 62 of the decorative panel 14, past the edges of the clear sheet 16 and artwork 12, and align with at least one side-wall 52 of the platform 50 to allow joining of the insert attachment features 36*b* with the base attachment features 36*a* on the platform 50. This firmly holds the layers (decorative panel 14, clear sheet 16, artwork 12, support backing 32) together and locks them in place. Not only does this maintain alignment, but such locking assists in stretching and holding the material of the decorative panel 14 in place. This is due to the insert pulling at least some of the decorative material through the opening 18 in tension. Further, the one or more border segments 60 cover any free edges of the material of the decorative panel 14 along the opening 18 so as to prevent fraying of the decorative material and to cover any gaps or wrinkles in the material along the opening 18. Thus, the insert 34 provides a polished look to the opening 18 which accents and "frames" the artwork 12.

In some embodiments, the support backing 32 includes one or more hanging holes 66 for hanging the support backing 32 on a wall. In this embodiment, the support backing 32 includes a hanging hole 66 along a long side of the support backing 32, wherein the hole 66 is slipped over a nail on a wall so as the hang the decorative system 10 in a landscape orientation. Likewise, the support backing 32 includes a hanging hole 66 along a short side of the support backing 32, wherein the hole 66 is slipped over a nail on a wall so as the hang the decorative system 10 in a portrait orientation. In addition, in some embodiments, the support backing 32 includes a leg 65 mounted on the back side 42 of the support backing 32 for the decorative system 10 to lean against while propped on a table top or similar surface. It may be appreciated that the leg 65 is shaped and configured to allow both landscape and portrait orientations. Thus, the display system 10 itself can be mounted on a wall or positioned on a table top. However, the display system 10 is designed to be positionable within a conventional picture frame.

Conventional picture frames are traditionally made of wood, however other materials may be used including silver, bronze, aluminum, and plastics such as polystyrene. A picture frame may be of any color or texture, and gilding is common, especially on older wooden frames. Some picture frames have elaborate molding which may relate to the subject matter. Most conventional picture frames have a presser plate (typically made of cardboard) that is attachable to the back side of the frame. The presser plate holds the artwork therein. The presser plate is typically held in place by swinging finger pieces that are pivotally secured on pins and carried with the frame. According to embodiments of the methods of the present invention, the presser plate is removed and replaced with the display system 10 so that the support backing 32 is accessible from the back rather than the presser plate. The display system 10 is held in the frame by the available mechanism, such as the swinging finger pieces. Thus, the display system 10 does not add additional bulk to the frame and can be used with any existing frame, including antiques.

Interlocking Mounting Structure

As mentioned previously, the interlocking mounting structure 30 holds the decorative panel 14, artwork 12 and optional clear sheet 16 together in proper alignment while assisting in stretching and holding the material of the decorative panel 14 in place, protecting the edges of the material along the opening 18 of the decorative panel 14 and providing a polished look to the opening 18 which compliments the artwork 12. The interlocking mounting structure 30 is comprised of the support backing 32 and insert 34.

Figure 2:
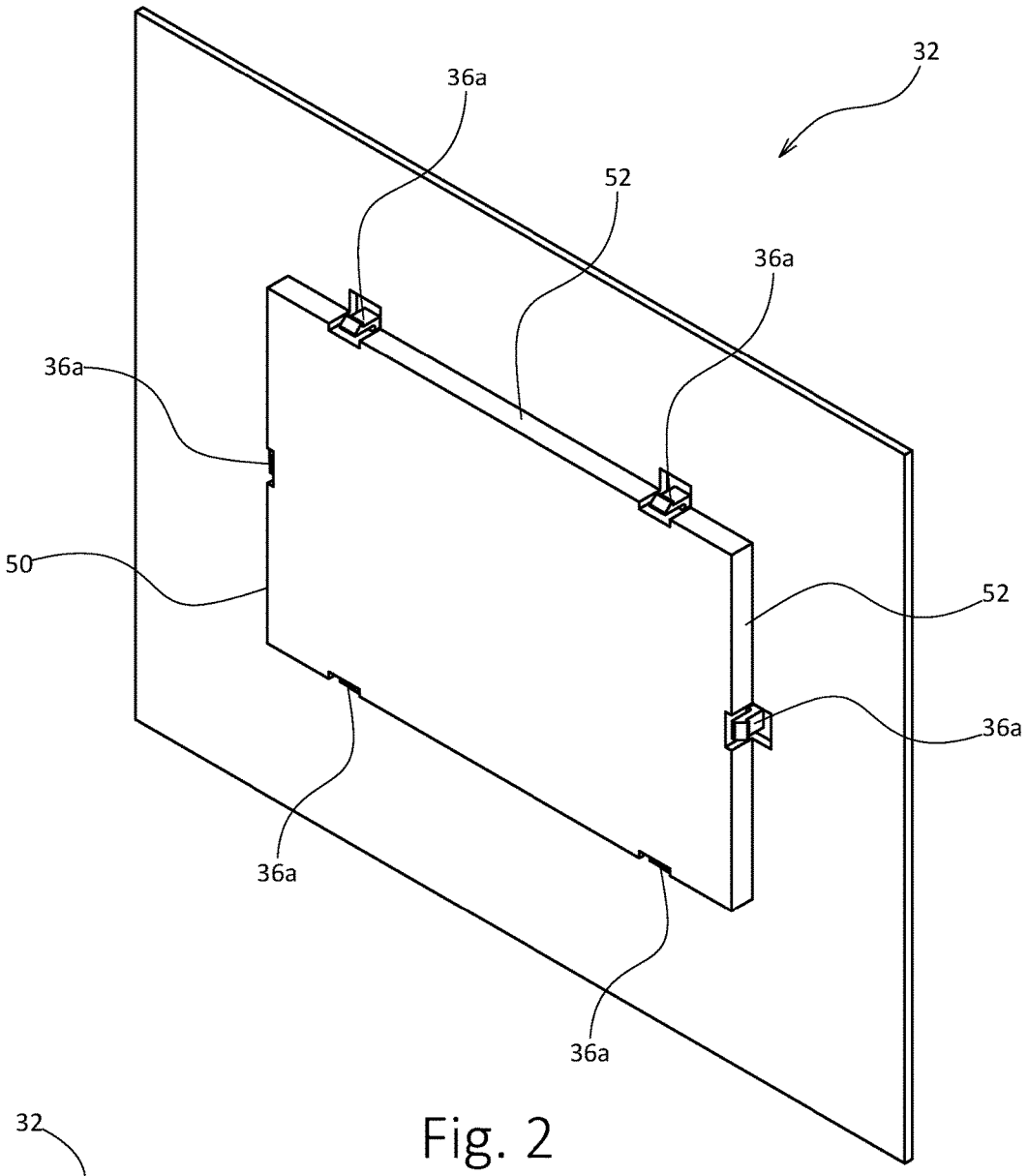
FIG. 2 illustrates an embodiment of a support backing.
Figure 3:
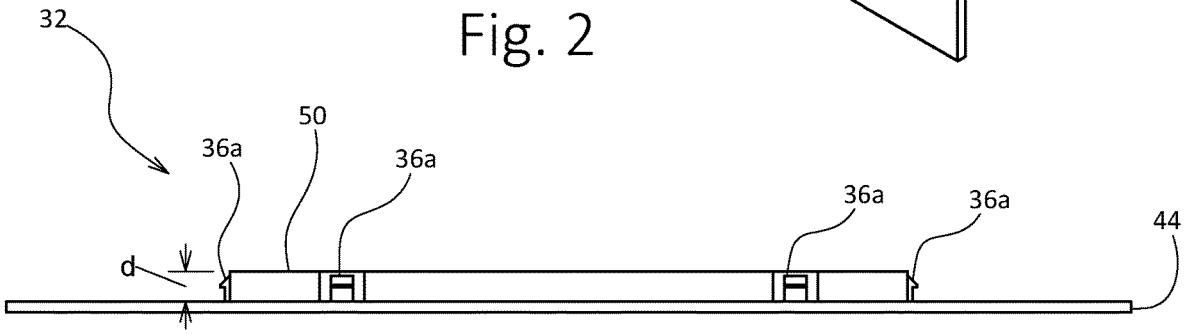
FIG. 3 provides a side view of the support backing of FIG. 2.

FIG. 2 illustrates an embodiment of a support backing 32. In this embodiment, the support backing 32 is comprised of a body 44 having a rectangular shape but it may be appreciated that it may have any suitable shape, including square, circular, oval, triangular, polygonal, etc. The body 44 is typically comprised of a rigid material, such as plastic, resin, cardboard, wood or the like. However, it may be appreciated that the body 44 may be comprised of a flexible material. In this embodiment, the body 44 is largely solid, however in other embodiments the body 44 is comprised of a mesh or structure having slats, holes or other openings. The support backing 32 includes a platform 50 having a top surface 46 which is raised above the body 44. Since the platform 50 is raised, the platform 50 includes at least one side-wall 52 that defines the perimeter of the platform 50. In some embodiments, the at least one side-wall 52 extends around the perimeter of the platform 50, however it may be appreciated that in some embodiments portions of the side-wall 52 may be removed or missing. FIG. 3 provides a side view of the support backing 32 of FIG. 2. Referring to FIG. 3, the top surface 46 of the platform 50 is disposed a distance d above the body 44. In some embodiments, distance d is in the range of 0.062 to 0.875 inches. In one embodiment, wherein the platform 50 has a length of 6 inches and a width of 4 inches (such as to hold a 4×6 photograph), the distance d is approximately 0.175 inches. In this embodiment, the support backing 32 has a length of 10 inches and a width of 8 inches. Thus, such a support backing 32 is able to dimensionally fit into a standard 8×10 picture frame. It may be appreciated that such dimensions are illustrative and the dimensions of the platform 50 and support backing 32 may vary to accommodate various types and styles of artwork and frames. Likewise, it may be appreciated that the distance d may vary to accommodate these variations. Referring again to FIG. 3, the distance d allows for the thickness of the decorative panel 14 when mounted on the support backing 32. In particular, the decorative panel 14 is positionable against the body 44 so that its opening 18 concentrically aligns with the platform 50 and the edges of the opening 18 are adjacent to the perimeter of the platform 50. The platform 50 extends through the opening 18, holding the artwork 12 upwards toward the decorative side of the decorative panel 14. This way, if the decorative panel 14 is thick, the artwork 12 is not buried deeply within the opening 18 and is therefore easily visible to the viewer.

In the embodiment of FIGS. 2-3, a plurality of base attachment features 36*a* are disposed along the at least one side-wall 52 of the platform. In this embodiment, at least one base attachment feature 36*a* is disposed along each side-wall 52; in particular two base attachment features 36*a* are disposed along each long side of the rectangle shape and one base attachment feature is disposed along each short side of the rectangular shape. A variety of different types of base attachment features 36*a* may be used. In this embodiment, the base attachment feature 36*a* on the platform 50 comprises clip design which snaps into a corresponding window in the insert 34, as will be described in more detail in later sections. It may be appreciated that other types and styles of base attachment features 36*a* may be used. In addition, it may be appreciated more than one type or style of attachment feature may be present along the platform 50 and/or insert 34.

Figure 4:
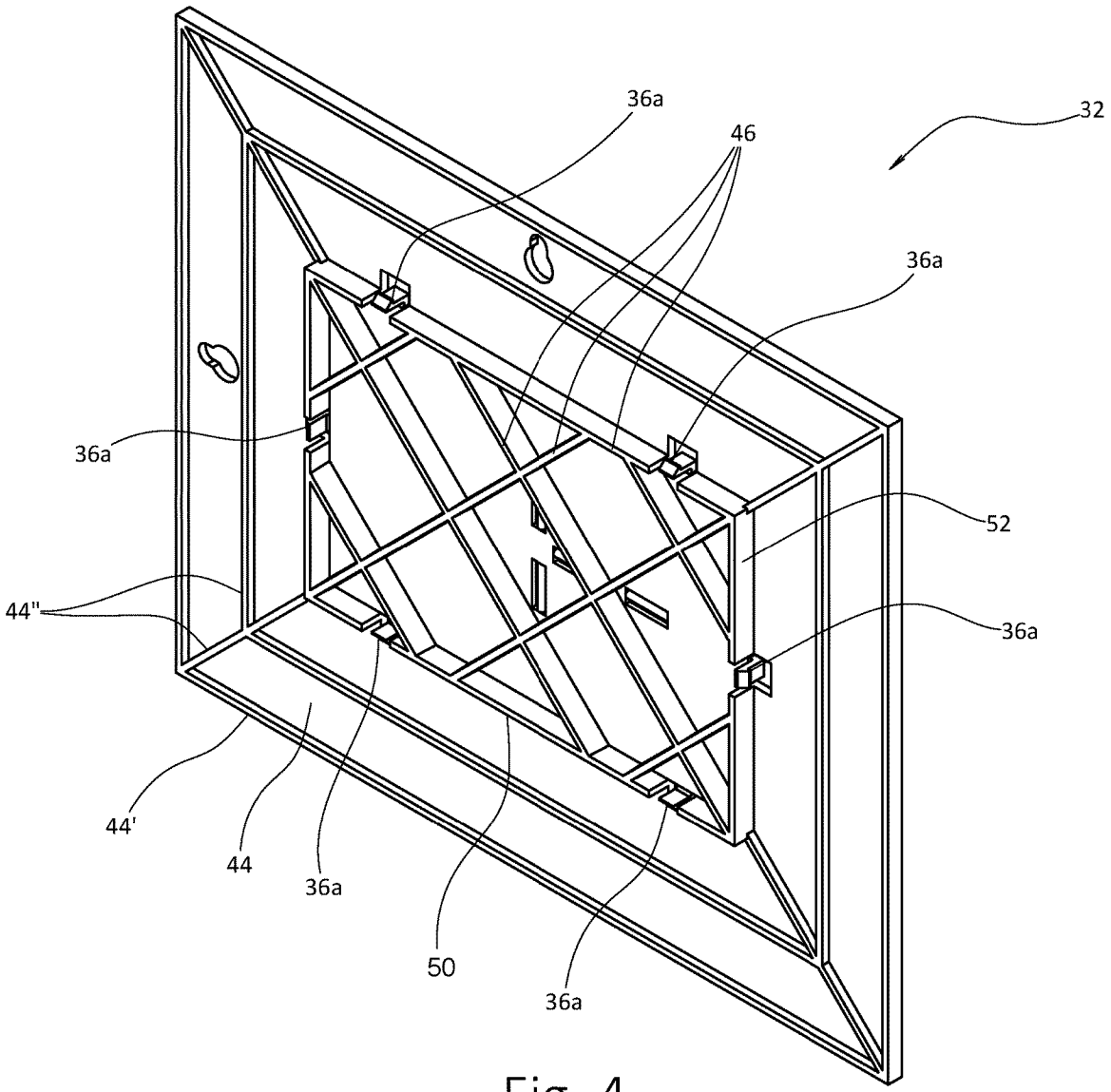
FIG. 4 illustrates an embodiment of a support backing wherein portions of the platform and body are removed or not present.

It may be appreciated that, in some embodiments, the platform 50 and/or the body 44 may have portions removed or missing to conserve material and reduce weight. Thus, rather than a solid piece, portions of the platform 50 or body 44 are carved away leaving behind enough structure to maintain integrity and structure support. Likewise, if the piece is molded, divots or depressions are molded into the piece to reduce material. FIG. 4 illustrates an embodiment of a support backing 32 wherein portions of the platform 50 and body 44 are removed or not present. Here, the top surface 46 of the platform 50 remains along the perimeter of the platform 50 so as to define the platform boundaries. Likewise, the top surface 46 of the platform 50 remains in a cross-hatched pattern across the platform 50. This provides sufficient support for the artwork 12 to be mounted thereon. Similarly, a receiving area surface 44', 44" of the body 44 remains upon which the decorative panel 14 is mounted. This occurs along the outer perimeter of the body (surface 44') and in a cross-hatched pattern across the body (surface 44"). It may be appreciated that various patterns may be used so as to achieve the same or similar effect. Likewise, it may be appreciated that such portions may be removed or not present on the back side 42 rather than the front side 40. However, for visual aesthetics, one may prefer to have the removed portions on the front side 40 so that the back side 42 is flat and continuous as it may be visible when in use.

Figure 5:
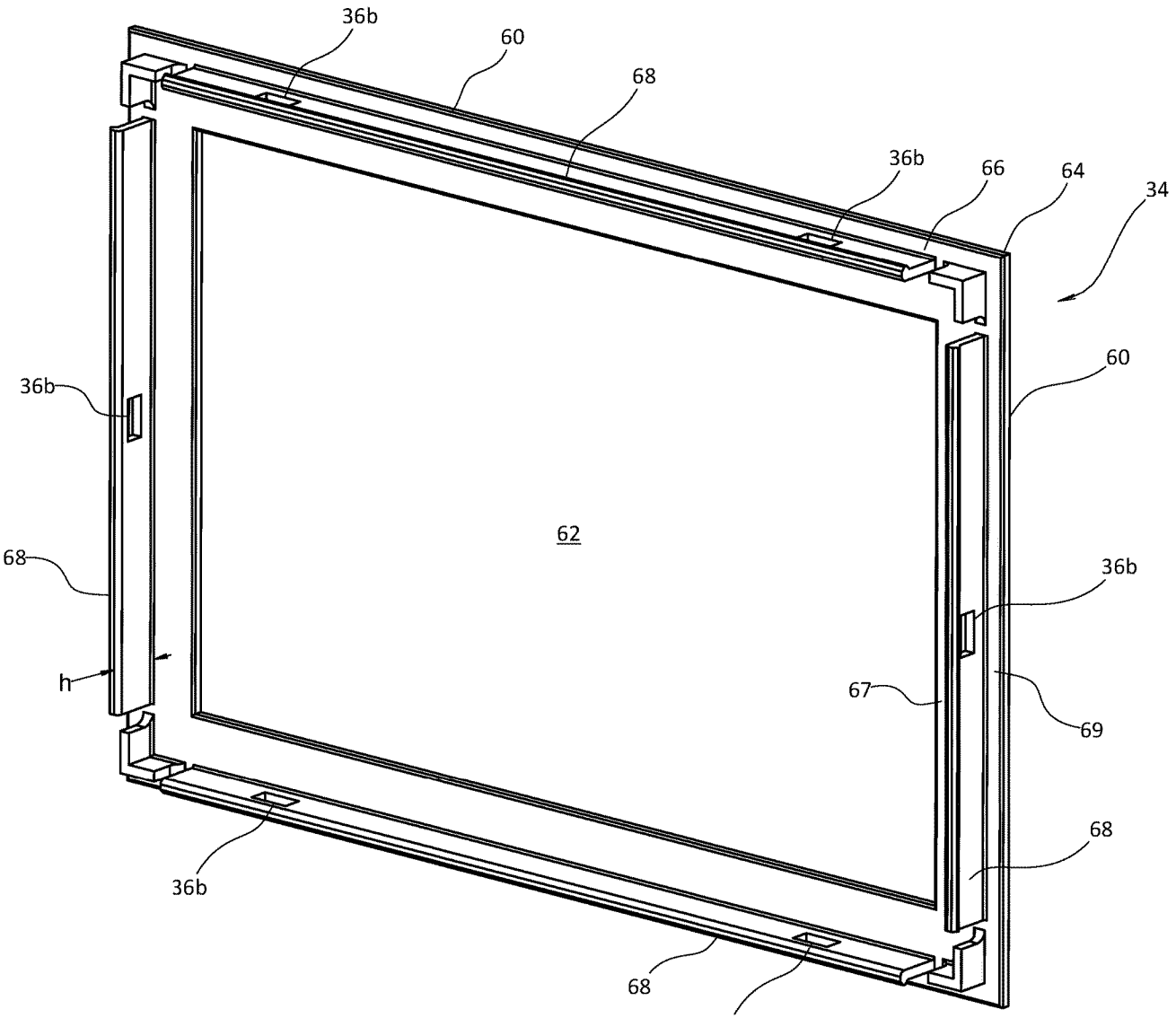
FIG. 5 illustrates an embodiment of an insert which is joinable with the support backing, particularly the platform.

FIG. 5 illustrates an embodiment of an insert 34 which is joinable with the support backing 32, particularly the platform 50. In this embodiment, the insert 32 is comprised of one or more segments 60 that surround an opening 62 (i.e. one continuous segment 60 may surround the opening 62 or various smaller segments 60 may be linked together to surround the opening 62). In this embodiment, the border segments 60 are relatively narrow so as to "frame" the opening 62. The opening 62 may have a variety of shapes, including rectangular, square, circular or oval to name a few. In this embodiment, the opening 62 has a rectangular shape and therefore the border segments 60 form a rectangle.

The insert 34 has a front side 64 and a back side 66. The front side 64 has an aesthetically pleasing surface and can resemble the borders of a picture frame. Thus, the front side is often smooth with a desirable finish. FIG. 5 illustrates the back side 66 of the insert 34. In this embodiment, the insert 34 includes one or more walls 68 which protrude from the back side 66. Each wall 68 extends along a portion of the border segments 60 and protrudes outwardly (typically at a 90-degree angle to the border segment) so as to not obscure or block the opening 62. Each wall 68 has a height h which is compatible with the distance d of the platform 50. It is not necessary that the height h matches the distance d, however such dimensions are compatible so as to allow the attachment features 36*a*, 36*b* to properly join.

In this embodiment, at least one insert attachment feature 36*b* is disposed along each portion of the border segments 60; in particular two insert attachment features 36*b* are disposed along each long side of the rectangle shape and one insert attachment feature 36*b* is disposed along each short side of the rectangular shape. A variety of different types of insert attachment features 36*b* may be used. In this embodiment, each insert attachment feature 36*b* comprises a window which receives clip on the platform 50, as will be described in more detail below. It may be appreciated that other types and styles of insert attachment features 36*b* may be used. In addition, it may be appreciated more than one type or style of insert attachment feature 36*b* may be present along the insert 34 and/or platform 50.

The walls 68 divide the border segments 60 into a first area 67 between the wall 68 and the opening 62 and a second area 69 between the wall 68 and the outer edge of the insert 34. The first area 67 overlaps the artwork 12 so as to hide the edges of the artwork 12. The second area 69 overlaps the decorative panel 14 so as to cover the edges of the opening 18 and any free edges of the decorative material along the opening 18. This prevents fraying of the material and covers any gaps or wrinkles in the material along the opening 18. Force of the wall 68 and the second area 69 against portions of the decorative panel 14 upon interlocking of the attachment features 36*a*, 36*b* also assists in stretching and holding the material of the decorative panel 14 in place, particularly in a uniform manner Stretching is achieved because the walls 68 pull (by frictional force) the material downward along the edges of the opening 18 when the insert 34 pressed into the opening 18 of the decorative panel 14. Since the material is held along the outside edge of the decorative panel 14, such pulling along the edge of the opening 18 holds the needlework in a taught and stretched configuration. In some embodiments, the walls 68 are largely continuous so as to provide even stretching along the edges of the opening 18. Likewise, the material is held in this stretched configuration due to the attachment. Thus, the insert 34 provides both an aesthetic and functional use.

Figure 7:
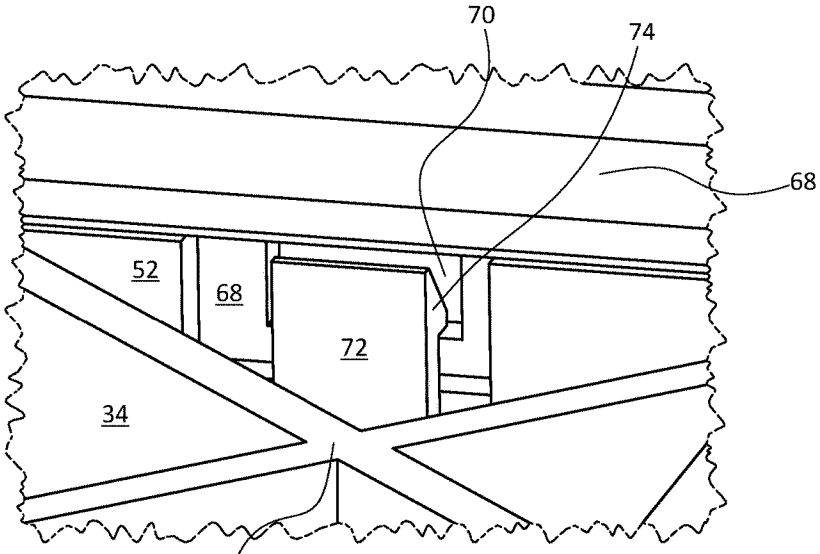
FIGS. 6-7 illustrate the joining of the attachment features on the support backing (FIG. 2) and insert (FIG. 5), respectively.
Figure 6:
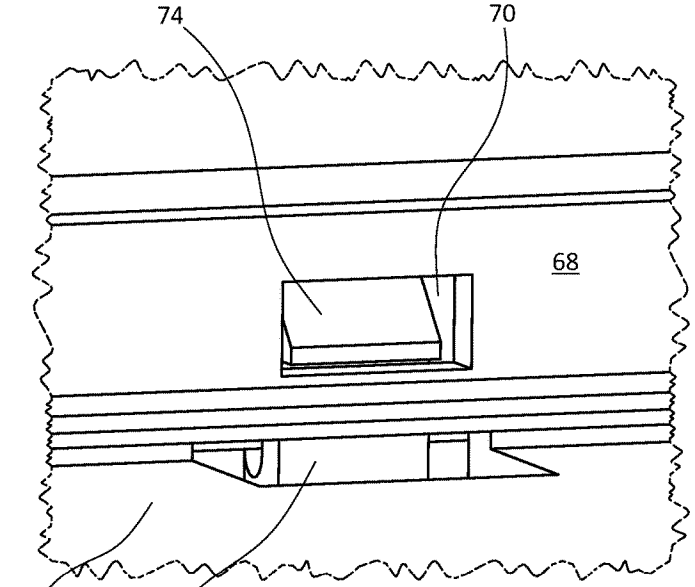

FIGS. 6-7 illustrate an embodiment of the joining of the attachment features 36*a*, 36*b* on the support backing 32 (FIG. 2) and insert 34 (FIG. 5), respectively. FIG. 6 illustrates an embodiment of the wall 68 of the insert 34 wherein the insert attachment feature 36*b* comprises a cut-through or window 70 in the wall 68. In this embodiment, the base attachment feature 36*a* on the support backing 32 comprises a clip 72 having an elongate shape and a protrusion 74 near its free end which protrudes through the window 70. In this embodiment, the protrusion 74 has a downward slanted shape to assist in passing a portion of the wall 68 over the protrusion 74 so that the protrusion protrudes through the window 70. Once the protrusion 74 extends through the window 70, the wall 68 of the insert 34 is held in engagement with the support backing 32. FIG. 7 provides an additional view of the clip 72, wherein the protrusion 74 is extending through the window 70 of a wall 68 on the insert 34. It may be appreciated that the attachment features 36*a*, 36*b* may be disengaged if desired. This is achieved by applying upward force on the insert 34 which ultimately flexes the free end of the clip 72 away from the window 70 so that the protrusion 74 is disengaged from the window 70. This allows the insert 34 to be removed. The attachment features 36*a*, 36*b* may be engaged and disengaged any number of times, such as to disassemble and reassemble the display system 10 when changing the artwork 12 and/or decorative panel 14. Likewise, the insert 34 can also be changed to a different insert 34 for aesthetic purposes.

As mentioned, a variety of different types of attachment features 36*a*, 36*b* may be used and are not limited by the examples set forth herein. In one example, the attachment features 36*a* on the platform 50 comprise windows 70 and the attachment features 36*b* on the insert 34 comprises clips 72. Thus, the mechanism is reversed. In other embodiments, the attachment features 36*a*, 36*b* comprise hooks, snaps, or knobs to name a few.

Decorative Panel

Figure 8:
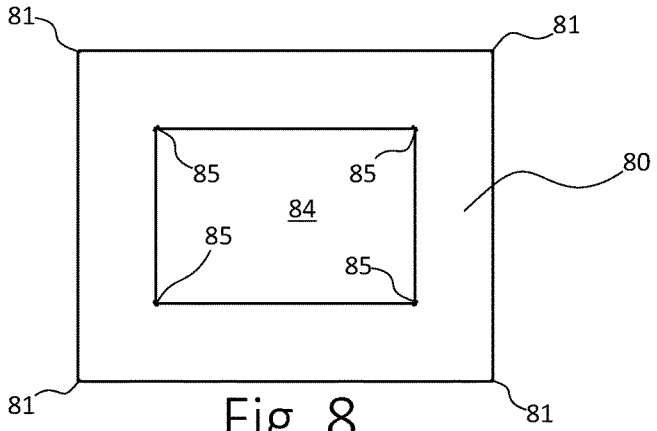
FIG. 8 illustrates an embodiment of a board having a rectangular shape with an opening also having a rectangular shape.

FIGS. 8-13 illustrate methods and devices related to generating an embodiment of a decorative panel 14. In this embodiment, the decorative panel 14 is comprised of a board structure 80 upon which decorative material 82 is mounted. The board structure 80 is typically constructed of a rigid material, such as cardboard, cardstock, wood, plastic, foam, etc. FIG. 8 illustrates an embodiment of a board structure 80 having a rectangular shape (having four exterior corners 81) with an opening 84 also having a rectangular shape (and thus four interior corners 85). Thus, the board structure 80 forms a border around the opening 84. Opening 84 ultimately forms opening 18 of the decorative panel 14 so that the artwork 12 can be seen therethrough. Thus, the board structure 80 acts as a mat to the artwork 12.

Figure 9:
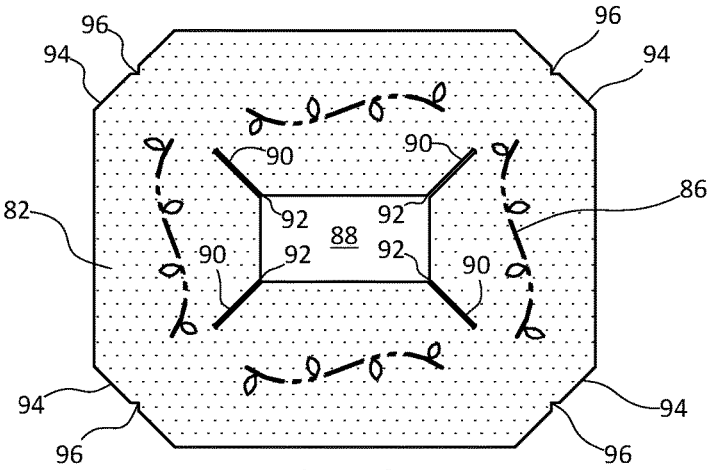
FIG. 9 illustrates an embodiment of the decorative material used to cover the board.

FIG. 9 illustrates an embodiment of the decorative material 82 used to cover the board structure 80. As mentioned previously, the decorative material 82 typically comprises a canvas, fabric or similar material which includes needlework 86 such as embroidery, needlepoint, cross-stitch, petit point, and bargello, to name a few. The material 82 is cut into a shape which is easily wrappable around the board structure 80. In some embodiments, a template or cutting guide (not shown) is provided to indicate the shape in which to cut the material 82. It may be appreciated that in this embodiment the cutting guide would have the same shape as the material 82 in FIG. 9 and would be comprised of a rigid material to trace around or a flexible material to pin to the decorative material, such as a sewing pattern. Thus, the material 82 is cut so as to have an opening 88 which is smaller than opening 84 of the board structure 80. Typically, the opening 88 has the same shape as the opening 84 of the board structure 80, such as rectangular. In addition, slits 90 are cut into the material 82 around the opening 88. In this embodiment, the opening 88 has four corners 92 due to its rectangular shape. Slits 90 are cut from the corners 92 radially outward.

Figure 10:
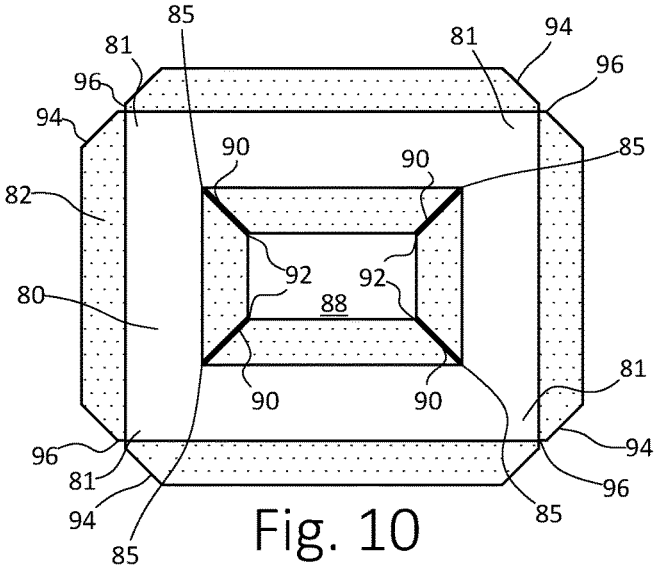
FIG. 10 illustrates the board positioned over the decorative material so that the board structure covers the needlework.

FIG. 10 illustrates the board structure 80 positioned over the decorative material 82 so that the board structure covers the needlework 86. Here, the material 82 is face down so that the board structure 80 rests against the back side of the needlework 86. As shown, the slits 90 are cut from the corners 92 radially outward to the corners 85 of the opening 84 of the board structure 80. In addition, the outside corners of the material 82 are trimmed at an angle along an edge 94 so that each corner 81 of the board structure 80 extends to an edge 94 of the material 82. In some embodiments, a notch 96 is cut along each edge 94 for alignment with each corner 81. Thus, the material 82 forms flaps around the board structure 80, both along its outer perimeter and along its inner opening 84. This shape ensures that the decorative material is not folded upon itself when wrapped around the board structure 80 so as to avoid undesirable bulk.

Figure 11:
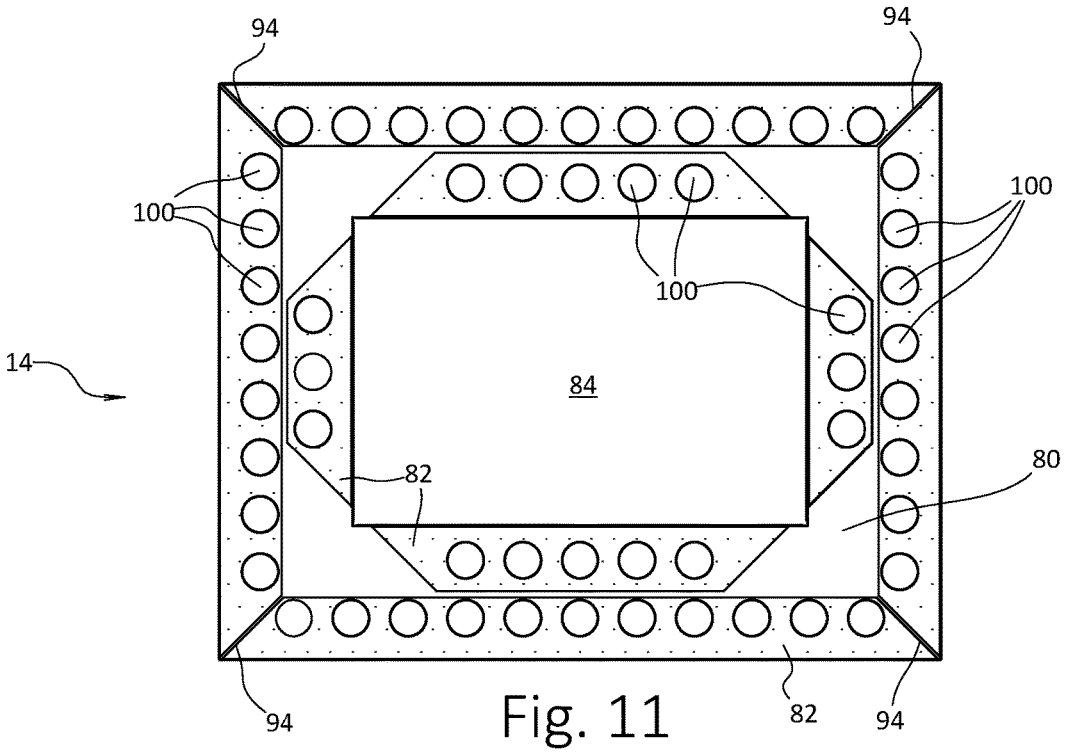
FIG. 11 illustrates the flaps of the material folded over the board structure and fixed in place with fixation devices.

FIG. 11 illustrates the flaps of the material 82 folded over the board structure 80 and fixed in place with fixation devices 100. Thus, the inner flaps are pulled through the opening 84 of the board structure 80 and fixed to the board structure 80. Likewise, the outer flaps are wrapped around the perimeter of the board structure 80 and fixed thereto as well. It may be appreciated that any suitable fixation devices 100 may be used such as tacks, nails, screw, brads, adhesive tape, etc. Such fixation devices 100 are typically strong enough to hold the material 82 in tension. In some embodiments, the fixation devices 100 are removable so as to allow removal of the material 82 from the board structure 80, such as to exchange the material 82 with others. It may be appreciated that in some embodiments the material is fixed to the board structure 80 with an adhesive such as glue and may not be removable.

Figure 12:
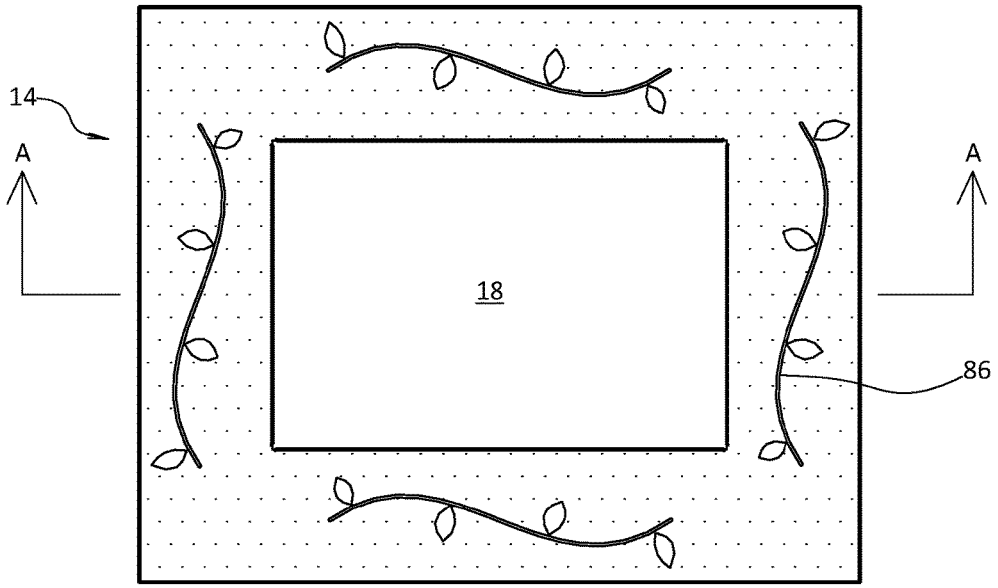
FIG. 12 illustrates the decorative panel of FIG. 11 flipped over and shown from the front.
Figure 13:
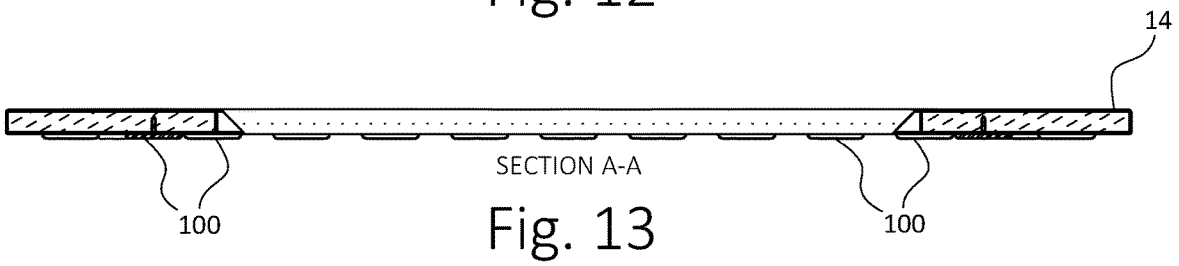
FIG. 13 provides a side view of the decorative panel.

FIG. 12 illustrates the decorative panel 14 of FIG. 11 flipped over and shown from the front. Thus, the material 82 covers the board structure 80 (now not seen) and displays the needlework 86. FIG. 13 provides a side view of the decorative panel 14 along A-A. As shown, the fixation devices 100 are mounted on the backside of the decorative panel 14, holding the material 82 in place.

Assembly

Figure 14:
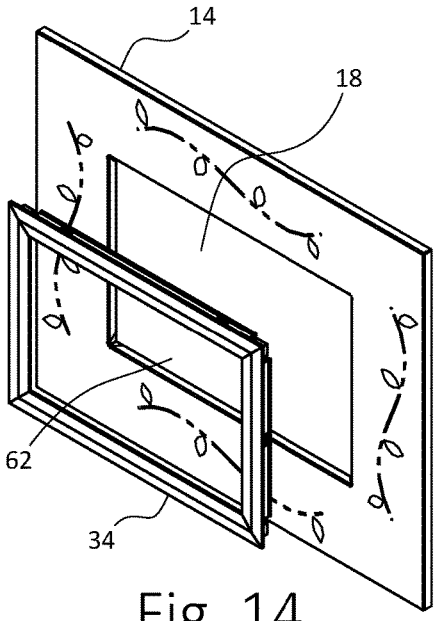
FIG. 14 illustrates the opening of the insert aligned with the opening of the decorative panel.
Figure 15:
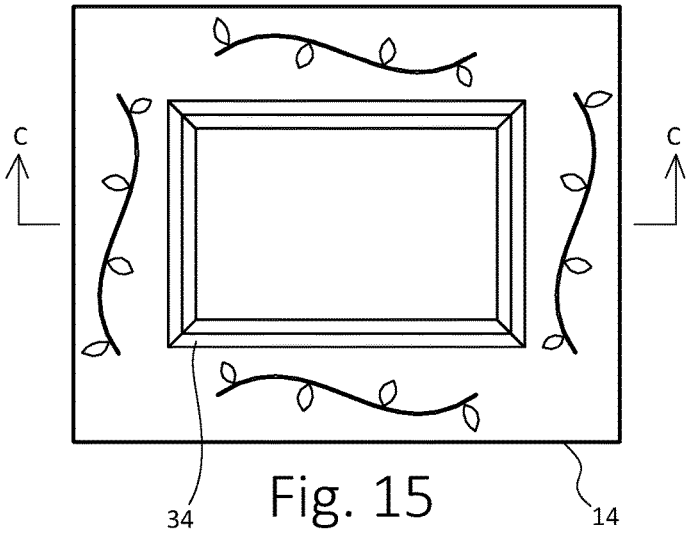
FIG. 15 illustrates the insert joined with the decorative panel.
Figure 16:
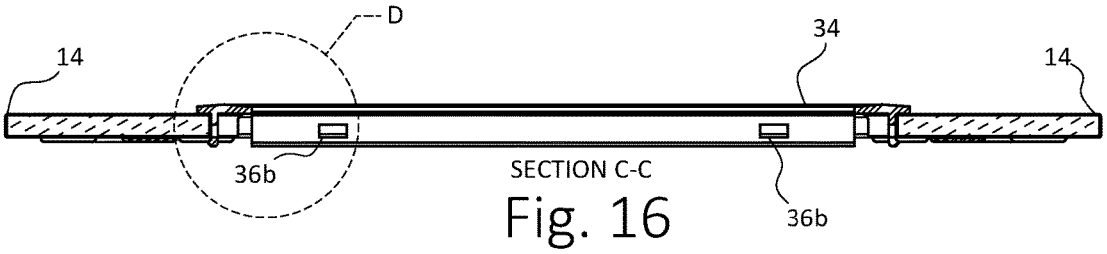
FIG. 16 provides a cross-sectional view of the joined insert and panel of FIG. 15.
Figure 17:
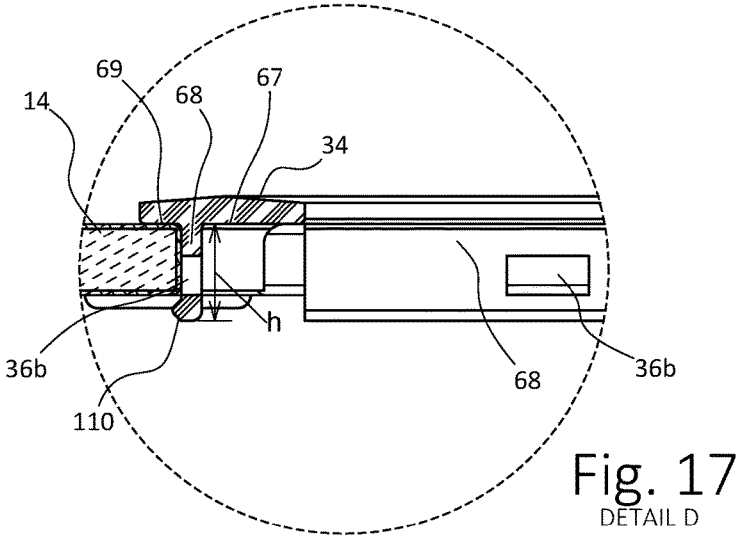
FIG. 17 provides a close-up view of the circled portion of FIG. 16.

The display system 10 is assembled as illustrated in FIG. 1. In some embodiments, the insert 34 is first joined with the decorative panel 14, as illustrated in FIGS. 14-15. First, the opening 62 of the insert 34 is aligned with the opening 18 of the decorative panel 14, as illustrated in FIG. 14. The insert 34 is then pressed upon the decorative panel 14 so that the walls 68 of the insert 34 pass through the opening 18, pulling the material 82 of the decorative panel 14 tightly toward the opening 18. FIG. 15 illustrates the insert 34 joined with the decorative panel 14. FIG. 16 provides a cross-sectional view of the joined insert 34 and panel 14 along line C-C. FIG. 17 provides a close-up view of the circled portion of FIG. 16. Referring to FIG. 17, a portion is cut away to illustrate the engagement of a wall 68 with the decorative panel 14. As shown, insert 34 is positioned so the first area 67 extends into the opening 18 and the second area 69 overlaps the decorative panel 14. In this embodiment, the wall 68 has a height h which is greater than the thickness of the decorative panel 14. In some embodiments, the height h is in the range of 0.125 to 1.125 inches. In this embodiment, the wall 68 has a lip 110 near its free end which extends at least partially around the edge of the opening 18 of the decorative panel 14 toward its back side. Thus, the decorative panel 14 is wedged between the second area 69 and the lip 110. As mentioned previously, this assists in tightening and holding the decorative material 82 around the edge of the opening 18.

Figure 18:
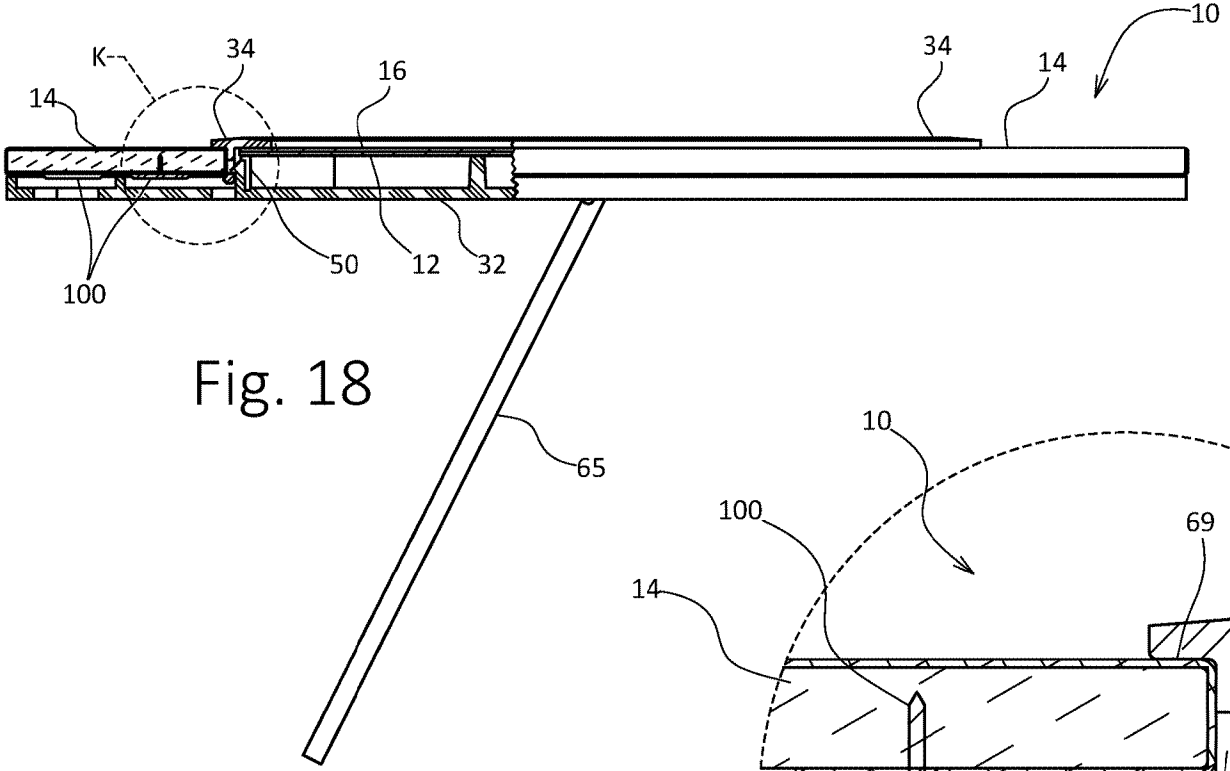
FIG. 18 illustrates an embodiment of the display system from a side view.
Figure 19:
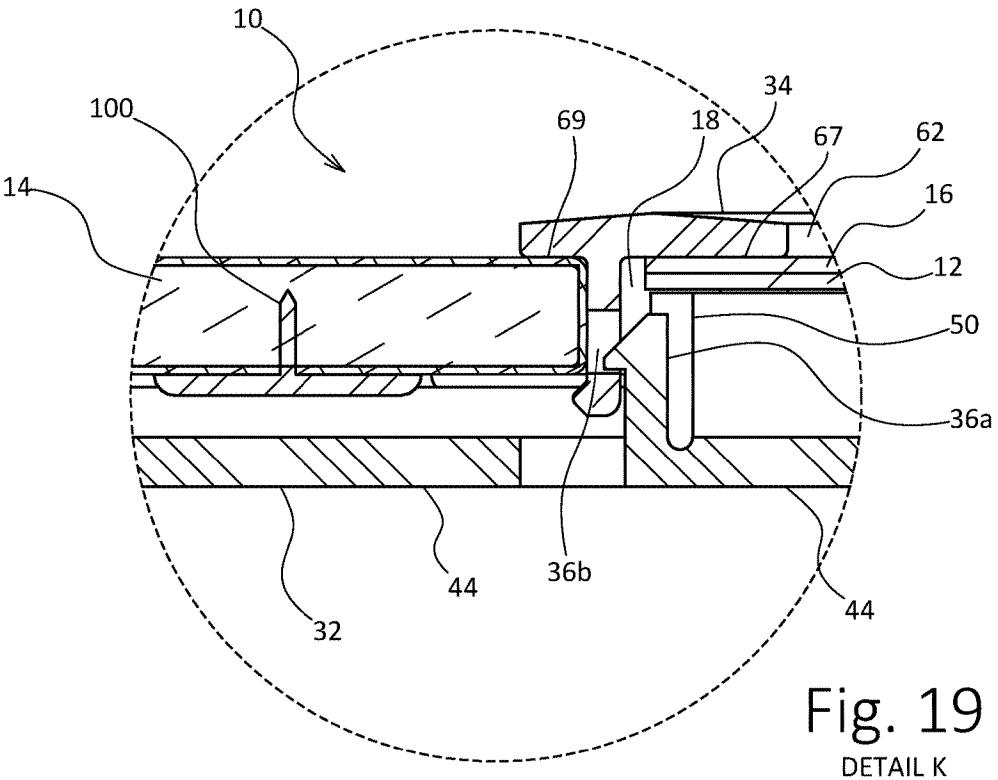
FIG. 19 provides a close-up view of the circled portion of FIG. 18.
Figure 20:
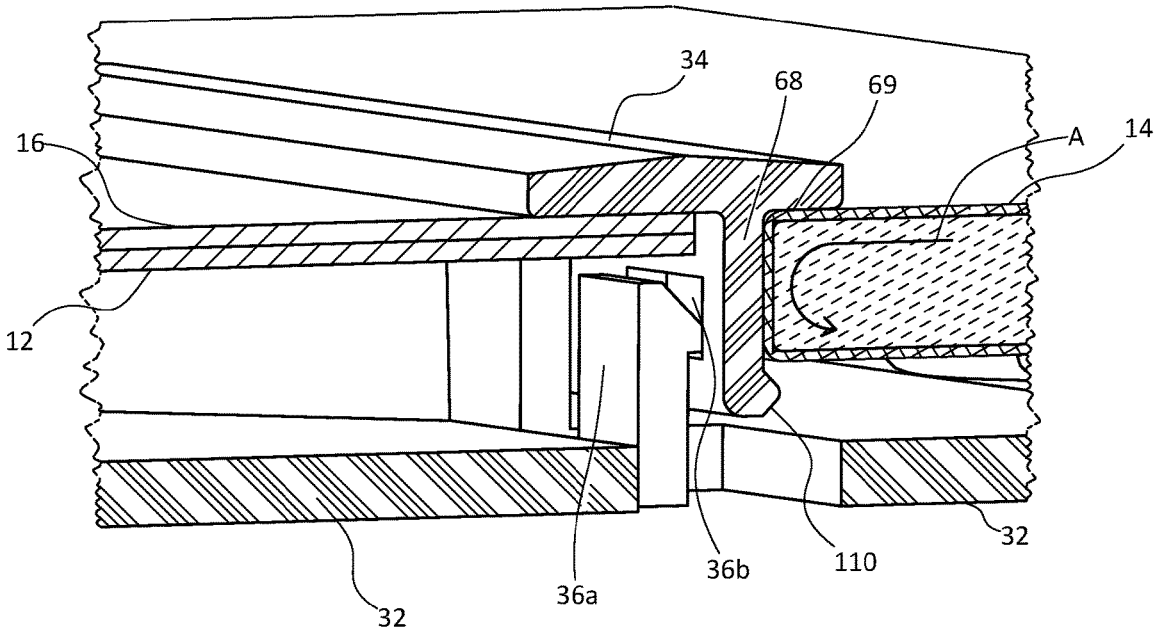
FIG. 20 provides an additional cross-sectional view of display system. This view is similar to that of FIG. 19, but on the opposite side of the opening and from a slight angle.

The joined insert 34 and decorative panel 14 are then joined with the support backing 32 upon which the artwork 12 and optional clear sheet 16 have been mounted, as illustrated in FIG. 18. FIG. 19 provides a close up view of the circled K portion of FIG. 18. As shown, the artwork 12 is mounted on the platform 50 of the support backing 32 and the clear sheet 16 is positioned over the artwork 12. The joined insert 24 and decorative panel 14 are mounted on the support backing 32 so that the base attachment feature **36*a* of the support backing 32 engages the insert attachment feature 36*b*. In this position, the first area 67 of the insert 34 overlaps and is held against clear sheet 16 and underlying artwork 12 and the second area 69 maintains its overlap of the decorative panel 14. Likewise, in this position, the decorative panel 14 is held against the body 44 of the support backing 32. Thus, when assembled, the clear sheet 16/artwork 12 are located at approximately the same height as the top surface of the decorative panel 14. This way the insert 34 is able to overlap both the decorative panel 14 and the clear sheet 16/artwork 12 at the same time. In addition, the wall 68 has a height h which is sufficient to allow engagement of the attachment devices 36*a*, 36*b*. FIG. 20 provides an additional cross-sectional view of display system 10. This view is similar to that of FIG. 19, but on the opposite side of the opening 18 and from a slight angle. Here, the insert 34 is shown joined with the decorative panel 14 and so that the walls 68 of the insert 34 pass through the opening 18, pulling the material 82 of the decorative panel 14 tightly toward the opening 18 (as indicated by arrow A). The wall 68 has a lip 110 near its free end which extends at least partially around the edge of the opening 18 of the decorative panel 14 toward its back side. Thus, the decorative panel 14 is wedged between the second area 69 and the lip 110. As mentioned previously, this assists in tightening and holding the decorative material 82 around the edge of the opening 18. Also shown, the insert attachment feature 36*a* is joined with base attachment feature 36*b* to hold the insert 34 in place, removably fixed to the support backing 32**.

Referring back to FIG. 19, FIG. 19 also illustrates an optional position of a fixation device 100, inserted into the backside of decorative panel 14. It may be appreciated that any fixation devices 100 are received by the body 44 when positioning the decorative panel 14 against the body 44, such as within a cut-away portion, divot or depression, such as shown.

Figure 21A:
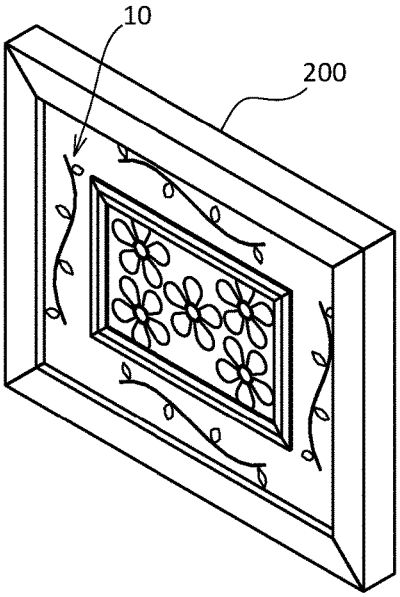
FIGS. 21A-21B illustrate an embodiment of the display system positioned within a picture frame.
Figure 21B:
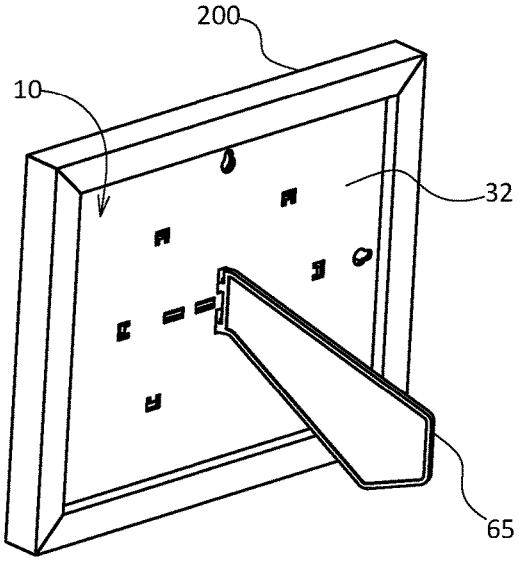

As mentioned previously, the display system 10 itself can be mounted on a wall or positioned on a table top, however, in some embodiments the display system 10 is designed to be positionable within a conventional picture frame. FIGS. 21A-21B illustrate an embodiment of the display system 10 positioned within a picture frame 200. FIG. 21A shows a front view of the display system 10 within the picture frame 200, and, FIG. 21B shows a back view of the display system 10 within the picture frame 200. As shown in FIG. 21B, the existing presser plate or backing of the picture frame 200 is removed and replaced with the display system 10 so that the support backing 32 is accessible from the back rather than the presser plate. The display system 10 is held in the frame 200 by mechanisms available on the frame 200, such as swinging finger pieces, or by additional hardware. Thus, the display system 10 does not add additional bulk to the frame and can be used with any existing frame.

It may be appreciated that the display system 10 may be interchanged with a variety of frames over time. Likewise, display system 10 is designed to be interchanged as the user desires, easily changing the artwork 12, decorative panel 14 (such as the decorative material 82), insert 34, and/or frame 200 at any time. In some embodiments, the frame 200 is matching or coordinated with the insert 34. In such instances, the frame 200 and insert 34 may be considered a set which can be packaged or sold together for use with the display system 10. Thus, a user of the display system 10 may purchase new frames 200 with coordinating inserts 34 to vary the look of the existing display system 10. Alternatively, the insert 34 may be of neutral appearance for use with any frame 200.

Multi-Opening Display Systems

For simplicity, the above embodiments have been described and illustrated as having a single opening to view one piece of artwork. However, it may be appreciated that the display systems of the present invention may be configured to display multiple pieces of artwork at the same time. For example, one, two, three, four, five, six, seven, eight or more pieces of artwork may be displayed simultaneously.

In some embodiments, the support backing 32 includes more than one platform 50, wherein artwork 12 is mounted on each platform 50. Likewise, a plurality of inserts 34 are provided, wherein each insert 34 is sized and shaped to correspond to each platform 50. It may be appreciated that the platforms 50 and corresponding inserts 34 may all have the same shape, such as rectangular, or may have differing shapes, such as a combination of rectangular and circular or oval. Likewise, it may be appreciated that the platforms 50 and corresponding inserts 34 may all be of the same size or may have differing sizes.

In addition, the decorative panel 14 is configured to have a plurality of openings 18, wherein each opening 18 is sized, shaped and arranged to correspond to each platform 50. Thus, the decorative material 82 is cut and wrapped around the board structure 80 of the decorative panel 14 so that the material passes through each of the openings 18. Each insert 34 is then aligned with an opening 18 and attached to the support backing 32 therethrough, such as described above.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A display system for displaying a decorative panel and artwork comprising:

an insert comprising at least one border segment that surrounds an opening for displaying the artwork, wherein the at least one border segment has an inner edge along the opening, an outer edge opposite the inner edge, a front side a back side and at least one wall extending from the back side wherein the at least one wall is disposed so that a portion of the at least one border segment extends unobstructed from the at least one wall to the outer edge away from the opening to create an overlap with the decorative panel when positioned within an inner opening of the decorative panel, and wherein the at least one wall has at least one lip extending away from the opening disposed a distance from the back side so that the decorative panel is positionable between the at least one border segment and the at least one lip so that the insert frames at least a portion of the inner opening of the decorative panel; and a support backing configured to receive the decorative panel and the artwork in an arrangement so that the artwork is viewable through the inner opening in the decorative panel, wherein the support backing is removably attachable to the insert and has a platform configured to receive the artwork upon its top surface, wherein the platform has a side wall at least partially around its perimeter and wherein the top surface is raised above the support backing so that the platform fits within the opening of the decorative panel.

2. A display system as in claim 1, wherein the at least one wall extends between the side wall of the platform and an edge of the opening of the decorative panel during attachment.

3. A display system as in claim 2, wherein the support backing includes at least one base attachment feature along the perimeter of the platform and the insert includes at least one insert attachment feature along the at least one wall, wherein the at least one base attachment feature and the at least one insert attachment feature are releasably joinable to cause the insert to be removably attachable to the support backing.

4. A display system as in claim 1, further comprising the decorative panel, wherein the decorative panel comprises a board structure having a surface coverable with a decorative material so that a portion of the decorative material extends through the inner opening.

5. A display system as in claim 4, further comprising a cutting guide configured to establish a shape for the decorative material for covering the surface of the board structure.

6. A display as in claim 1, wherein the insert has sufficient rigidity to be pressed upon the decorative panel so that the at least one wall passes through the inner opening of the decorative panel causing at least some material of the decorative panel to be pulled toward the inner opening in tension.

7. A display as in claim 6, wherein the distance of the at least one lip from the back side is configured to hold the material of the decorative panel in tension while the decorative panel is positioned between the at least one border segment and the at least one lip.

8. A display system as in claim 1, wherein the overlap with the decorative panel is sufficient to cover any free edges of the material of the decorative panel along the inner opening.

9. A display system as in claim 1, wherein another portion of the at least one border segment extends from the wall toward the opening to create an overlap with the artwork when the artwork is positioned within the opening of the insert.

10. A display system as in claim 1, wherein opening of the insert has a rectangular, square, circular or oval shape.

11. A display system as in claim 1, wherein the at least one wall extends at a 90-degree angle from the back of the at least one border segment.

12. A display system as in claim 1, wherein the insert has sufficient flexibility to be removable from the decorative panel.

13. A display system as in claim 1, wherein the at least one wall is substantially continuous along the at least one border segment.

14. A display system as in claim 1, wherein the at least one border segment has a rectangular shape having four corners and wherein the at least one wall extends along each of the four corners.

15. A method of using a display system comprising:

positioning an artwork on a platform of a support backing;

positioning a decorative panel on a receiving area surrounding the platform so that the artwork is visible through an opening in the decorative panel, wherein the decorative panel comprises a board structure at least partially covered by a decorative material;

aligning an insert so that its opening is concentric with the opening of the decorative panel, wherein the insert includes at least one wall protruding from a back side of the insert and at least one insert attachment feature; and advancing the at least one wall between the platform and the decorative panel so that at least a portion of the decorative material is drawn toward the opening of the decorative panel in tension.

16. A method as in claim 15, wherein the insert includes at least one insert attachment feature and the support backing includes at least one base attachment feature, the method further comprising joining the at least one insert attachment feature with the at least one base attachment feature to attach the insert to the support backing.

17. A method as in claim 16, further comprising unjoining the at least one insert attachment feature from the at least one base attachment feature to detach the insert from the support backing.

18. A method as in claim 17, further comprising removing the decorative panel from the receiving area, replacing the decorative material with another decorative material and repositioning the decorative panel having the another decorative material on the receiving area.

19. A method as in claim 15, further comprising inserting the support backing into a picture frame.

20. A display system for displaying a decorative panel and artwork comprising:

a support backing configured to receive the decorative panel and the artwork in an arrangement so that the artwork is viewable through an opening in the decorative panel, wherein the decorative panel comprises a board structure having a surface coverable with a decorative material so that a portion of the decorative material extends through the opening; and an insert having a front side and a back side which is removably attachable to the support backing, wherein at least one wall extends from the back side of the insert which pulls at least some of the material extending through the opening in tension while the front side frames the opening of the decorative panel, wherein the insert comprises border segments surrounding an insert opening and wherein each of the at least one walls extends from the backside of the insert so that there is a first area between the wall and the insert opening and a second area between the wall and an outer edge of the insert, wherein the first area is configured to extend over a portion of the opening of the decorative panel and the second area is configured to extend over a portion of the decorative panel when the insert is removably attached to the support backing.

21. A display system as in claim 20, wherein the support backing has a platform configured to receive the artwork upon its top surface, wherein the platform has a side wall at least partially around its perimeter and wherein the top surface is raised above the support backing so that the platform fits within the opening of the decorative panel.

22. A display system as in claim 21, wherein the at least one wall extends between the side wall of the platform and an edge of the opening of the decorative panel during attachment.

23. A display system as in claim 22, wherein the support backing includes at least one base attachment feature along the perimeter of the platform and the insert includes at least one insert attachment feature along the at least one wall, wherein the at least one base attachment feature and the at least one insert attachment feature are releasably joinable to cause the insert to be removably attachable to the support backing.

24. A display system as in claim 23, wherein at least one of the at least one base attachment features comprises a clip having a protrusion and at least one of the at least one insert attachment features comprises a window for receiving the protrusion.

25. A display system as in claim 24, wherein insertion of the at least one wall through the opening of the decorative panel aligns the protrusion with the window so that the protrusion extends therethrough resisting release of the insert from the backing panel.

26. A display system as in claim 24, wherein the protrusion is shaped to allow withdrawal of the protrusion from the window upon pulling the insert away from the support backing.

27. A display system as in claim 20, wherein the insert comprises border segments surrounding an insert opening and wherein each of the at least one walls extends from the backside of the insert so that there is a first area between the wall and the insert opening and a second area between the wall and an outer edge of the insert, wherein the first area is configured to extend over a portion of the opening of the decorative panel and the second area is configured to extend over a portion of the decorative panel when the insert is removably attached to the support backing.

28. A display system as in claim 20, further comprising the decorative panel, wherein the decorative panel comprises a board structure having a surface coverable with a decorative material so that a portion of the decorative material extends through the inner opening.

29. A display system as in claim 28, further comprising fixation devices for removably fixing the decorative material to the board structure.

30. A display system as in claim 28, further comprising a cutting guide configured to establish a shape for the decorative material for covering the surface of the board structure.

31. A display system as in claim 30, wherein the shape established by the cutting guide creates flaps for the portion of the decorative material extending through the opening.

* * * * *